US005749751A

United States Patent [19]

Shortt et al.

[11] Patent Number: 5,749,751

[45] Date of Patent: May 12, 1998

[54] CIRCUIT BREAKER

[75] Inventors: James Joseph Shortt, Galway; Shay Joseph Lavelle, Westport, both of Ireland

[73] Assignee: Square D Company, Palatine, Ill.

[21] Appl. No.: 624,777

[22] Filed: Mar. 27, 1996

[30] Foreign Application Priority Data

Apr. 4, 1995 [IE] Ireland ..... 950239

[51] Int. Cl.[6] ..... H01R 9/22

[52] U.S. Cl. ..... 439/721; 335/196

[58] Field of Search ..... 439/721, 723, 439/212, 884, 907; 335/196

[56] References Cited

U.S. PATENT DOCUMENTS 2,820,211 1/1958 Batcheller ..... 439/723

3,670,295 6/1972 Ege et al. ..... 439/721

4,436,358 3/1984 Coldren et al. ..... 439/83

FOREIGN PATENT DOCUMENTS 2651610 3/1991 France ..... 439/723

*Primary Examiner*—Gary F. Paumen

*Attorney, Agent, or Firm*—Larry I. Golden; Kareem M. Irfan; Wayne H. Stoppelmoor

[57] ABSTRACT

A circuit breaker (1) with a terminal connector (5). The terminal connector (5) has engagement means provided by outwardly extending male spade connectors (9*a*–9*d*) arranged in two spaced-apart offset parallel rows (7, 8). The circuit breaker (1) can therefore accommodate a maximum number of connectors (9*a*–9*d*) while allowing female spade connectors to be positioned regardless of orientation.

17 Claims, 5 Drawing Sheets

CIRCUIT BREAKER

FIELD OF THE INVENTION

The invention relates to a circuit breaker of the type having a circuit breaker housing with at least two supply terminals and a terminal connector electrically connected to at least one supply terminal, the terminal connector comprising a mounting means for mounting the terminal connector on the circuit breaker housing, and an engagement means carried on the mounting means for engaging at least one load device.

BACKGROUND OF THE INVENTION

It is frequently necessary to provide a quick-fit connection to either the line or load terminal of a circuit breaker. For example, in some industries such as heating and ventilating industry it is a recognised practice to terminate the wiring to the circuit breaker from a number of loads with a quick-fit or fast-on wire connector such as a spade type connector.

It is known to provide a circuit breaker with a supply terminal connector to receive such quick-fit wire connectors. It is known, for example, to secure a number of male spade terminal connectors to a circuit breaker terminal. One disadvantage of this arrangement, however, is that the terminal connector is secured at a single point and is prone to damage by repeated disconnection of the load device. Additionally the space limitations in narrow gauge circuit breakers often requires that quick-fit wire connectors be insulated. This imposes significant limitations on the number of possible connections which can be made to conventional terminal connectors.

SUMMARY OF THE INVENTION

According to the invention, the engagement means is provided by at least two spaced apart and offset rows of terminals. Advantageously this allows a maximum number of terminals to be mounted in the available space at the circuit breaker housing.

Preferably the terminals in each row are arranged in line. This allows rows of connector terminals to be formed from a single conductive strip.

Ideally adjacent terminals in different rows are offset laterally by greater than half the width of a terminal. This staggered arrangement of the terminals ensure that the greatest number of terminals are accommodated in the space available.

A circuit breaker as claimed in claim 3 wherein adjacent terminals in different rows are offset laterally by seventy five percent at the width of a terminal.

Preferably wherein a plane passing through the centres of adjacent connector terminals in different rows is at an acute offset angle of greater than one degree to a plane passing through the centres of adjacent terminals in the same row and ideally the acute offset angle is between one degree and sixty one degrees. This provides an optimal packing arrangement for the female spade connectors when mounted on the male spade connectors as the insulated portions are circular in section.

Preferably the acute offset angle is forty five degrees allowing an optimal packing arrangement to be achieved within the space available.

Preferably each terminal comprises a generally planar conducting plate defining a male connector for engaging a corresponding female connector at the end of a wire connected to a load device. This provides a reliable quick-fit connection for the circuit breaker required in certain applications.

Ideally the engagement means is a male spade connector. using this type of connector means that load devices in the field do not require connection of specialised equipment.

In a preferred arrangement adjacent terminals of the same row are spaced apart sufficiently to allow simultaneous engagement by a female spade connector.

Ideally each row of terminals is spaced-apart sufficiently from the circuit breaker housing to allow engagement by a female spade connector in either orientation of the female spade connector. This allows an operator to connect the load device quickly by obviating the need to check the orientation of the female spade connector.

Preferably adjacent rows of terminals are electrically connected, in this way the terminal connector can be formed from a single piece and can have a single connection to a supply terminal.

In one embodiment adjacent rows of terminals are substantially parallel thus facilitating production of the terminal connector.

Normally at least one connector terminal incorporates a stop shoulder for limiting engagement with a load device. Preferably at least one connector terminal incorporates at least one limit stop for maintaining engagement with a load device in use.

In a preferred embodiment the connector terminals extend outwardly from the mounting means.

In one arrangement the mounting means has a support means for supporting the engagement means and an associated locking means for locking the support means in position.

Preferably the circuit breaker housing defines a recess for receiving the locking means ensuring the terminal connector is securely mounted on the circuit breaker housing.

Preferably the support means is a generally planar mounting plate. This allows the terminal connector to be accurately positioned in the circuit breaker housing and prevents rotational movement during connection and disconnection of a load device.

Preferably the mounting plate is substantially perpendicular to the engagement means carried thereon and ideally the engagement means and mounting plate are formed from a single conductive strip.

In one arrangement the locking means is provided by a locking lug carried on and extending from the support means and preferably the locking lug and support means are co-planar. This allows the locking lug and support means to be integrally formed from a single strip of conductive material.

Preferably the locking means is provided by at least two oppositely directed locking lugs and preferably the locking lugs are located on opposite ends of the mounting plate. This ensures that the connector is securely mounted and is not subject to rotational movement during connection and disconnection.

In a particularly preferred arrangement the connector is generally S-shaped and mountable on the terminal in either orientation. This facilitates assembly of the circuit breaker units in that there is no need to check for alignment between the terminal connector and circuit breaker housing recesses.

According to another aspect of the invention there is provided a terminal connector for a circuit breaker of the type having a circuit breaker housing, at least one supply terminal, the terminal connector comprising:

a mounting means for mounting the terminal connector on the circuit breaker housing;

an engagement means carried on the mounting means for engaging at least one load device; and electrical connection means for connecting the engagement means to the supply terminal where preferably the engagement means is provided by at least two spaced-apart and offset rows of connector terminals.

Preferably the connector terminals in each row are arranged in line.

Preferably adjacent connector terminals in different rows are offset by greater than half the width of a terminal.

Preferably a plane passing through the centres of adjacent connector terminals in different rows is at an acute offset angle of greater than 10 degrees to a plane passing through the centres of adjacent terminals in the same row.

Preferably centres of adjacent connector terminals in different rows is at an acute offset angle of greater than one degrees to a plane passing through the centres of adjacent terminals in the same row.

Preferably the acute offset angle is between one degree and sixty one degrees.

Preferably the acute offset angle is forty five degrees.

Preferably the engagement means is a male spade connector.

Preferably the male spade connectors are substantially parallel.

Preferably at least one male spade connector incorporates a stop shoulder for limiting engagement with a female spade connector.

Preferably at least one male spade connector incorporates at least one limit stop for maintaining engagement with a load device in use provided by an indentation.

Preferably the male spade connectors extend outwardly from the mounting means.

Preferably the mounting means has a support means for supporting the engagement means and an associated locking means for locking the support means in position.

Preferably the support means is a generally planar, mounting plate.

Preferably the mounting plate is substantially perpendicular to the engagement means carried thereon.

Preferably the engagement means and mounting plate are formed from a single conductive strip.

Preferably the locking means is provided by a locking lug carried on and extending from the support means.

Preferably the locking lug and support means are co-planar.

Preferably the locking means is provided by at least two oppositely directed locking lugs.

Preferably the locking lugs are carried on opposite ends of the support means.

Preferably the connector is generally S-shaped and mountable on the circuit breaker housing in either orientation.

According to a further aspect of the invention there is provided a terminal connector for a circuit breaker of the type having a circuit breaker housing, at least one supply terminal, the terminal connector comprising:

a mounting means for mounting the terminal connector on the circuit breaker housing;

an engagement means carried on the mounting means for engaging at least one load device; and electrical connection means for connecting the engagement means to the supply terminal wherein the mounting means has a support means for supporting the engagement means and an associated locking means carried on the support means for locking the support means in position provided by a locking lug formed for engaging a corresponding formation on the circuit breaker housing.

Preferably the support means is a generally planar mounting plate.

Preferably the mounting plate is substantially perpendicular to the engagement means carried thereon.

Preferably the engagement means and mounting plate are formed from a single conductive strip.

Preferably the locking means extends from the support means.

Preferably the locking lug and support means are co-planar.

Preferably the locking means is provided by at least two oppositely directed locking lugs.

Preferably the locking lugs are carried on opposite ends of the support means.

Preferably the connector is generally S-shaped and mountable on the circuit breaker housing in either orientation.

Preferably the engagement means is provided by at least two spaced apart and offset rows of terminals.

Preferably the terminals in each row are laterally arranged in line.

Preferably adjacent terminals in different rows are offset laterally by greater than half the width of a terminal.

Preferably centres of adjacent connector terminals in different rows is at an acute offset angle of greater than one degree to a plane passing through the centres of adjacent terminals in the same row.

Preferably the acute offset angle is between one degree and sixty one degrees.

Preferably the acute offset angle is forty five degrees.

Preferably each terminal is a male spade connector.

Preferably the male spade connectors are substantially parallel.

Preferably at least one male spade connector incorporates a stop shoulder for limiting engagement with a load device.

Preferably at least one male spade connector incorporates a limit stop for maintaining engagement with a load device in use.

Preferably the conducting plates extend outwardly from the mounting means.

According to another aspect of the invention there is provided a circuit breaker terminal connector formed from a strip of conducting material having at least two upstanding, spaced apart rows of laterally arranged male spade connectors interconnected by a mounting plate, adjacent male spade connectors in different rows being offset laterally the mounting plate incorporating at least two oppositely directed, locking lugs, for engaging a corresponding formation on a circuit breaker housing.

In this specification the term "supply terminal" is taken to include both the load and line terminals of a circuit breaker. The term "circuit breaker" refers to both single pole and multipole devices. Additionally, the term "load device" is taken to mean any device which would load the electrical circuit to which the circuit breaker is attached, whether connected to the line terminal or the load terminal. The term "row" is taken to include a single terminal as well as a number of terminals in a row.

OBJECTS OF THE INVENTION

The present invention is directed towards providing a circuit breaker which can accommodate a maximum number of terminals in the available space of a circuit breaker housing.

Another object of the invention is to provide a quick fit circuit breaker terminal connector.

These and other features, advantages and objectives of the invention will be more clearly understood from the following description thereof, given by way of example only with reference to the accompanying drawings.

DETAILED DESCRIPTION OF THE PREFERRED EMBODIMENTS

Figure 1:
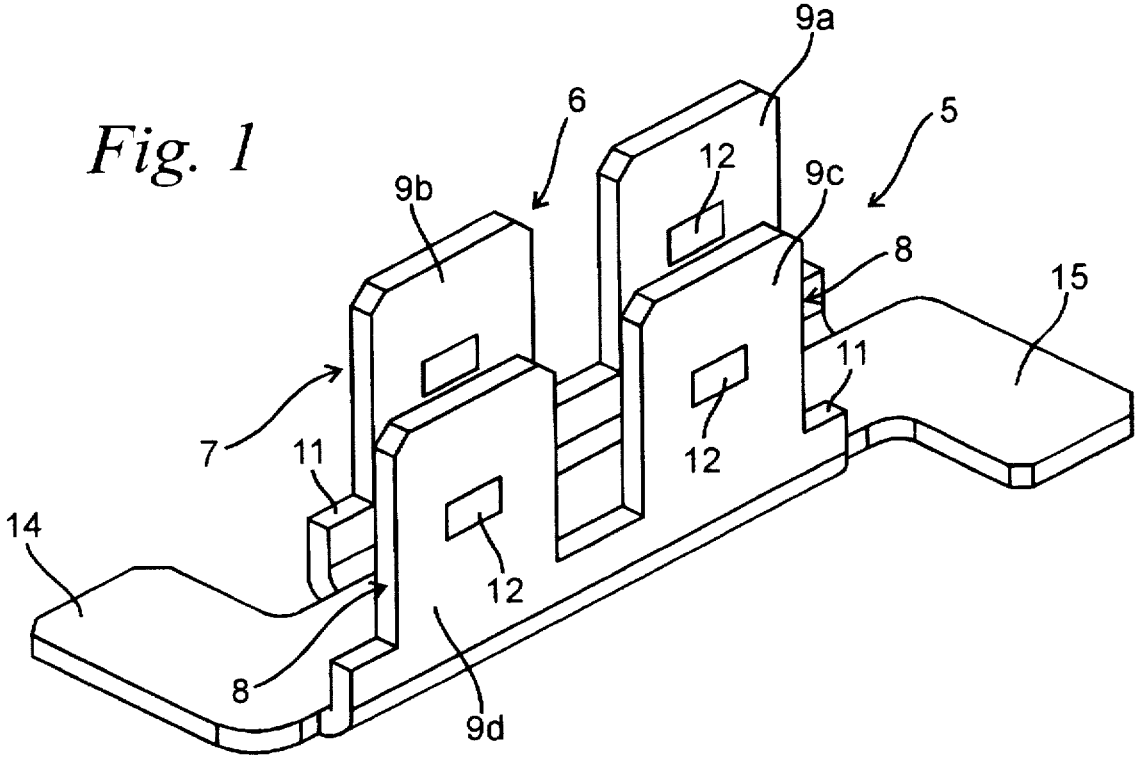
FIG. 1 is a perspective view, from above, of a terminal connector forming part of a circuit breaker according to the invention.

Referring to the drawings there is illustrated a circuit breaker according to the invention indicated generally by the reference numeral 1. The circuit breaker 1 has a housing 2, at least two supply terminals, in this case a line terminal 3, a load terminal 4 and a terminal connector 5 which in this case is electrically connected to the load terminal 4.

The terminal connector 5 has a mounting means provided by a mounting plate 13 for mounting the terminal connector 5 on the circuit breaker housing 2 and an engagement means 6 carried on the mounting plate 13 for electrical connection to at least one load device (not shown).

Figure 2:
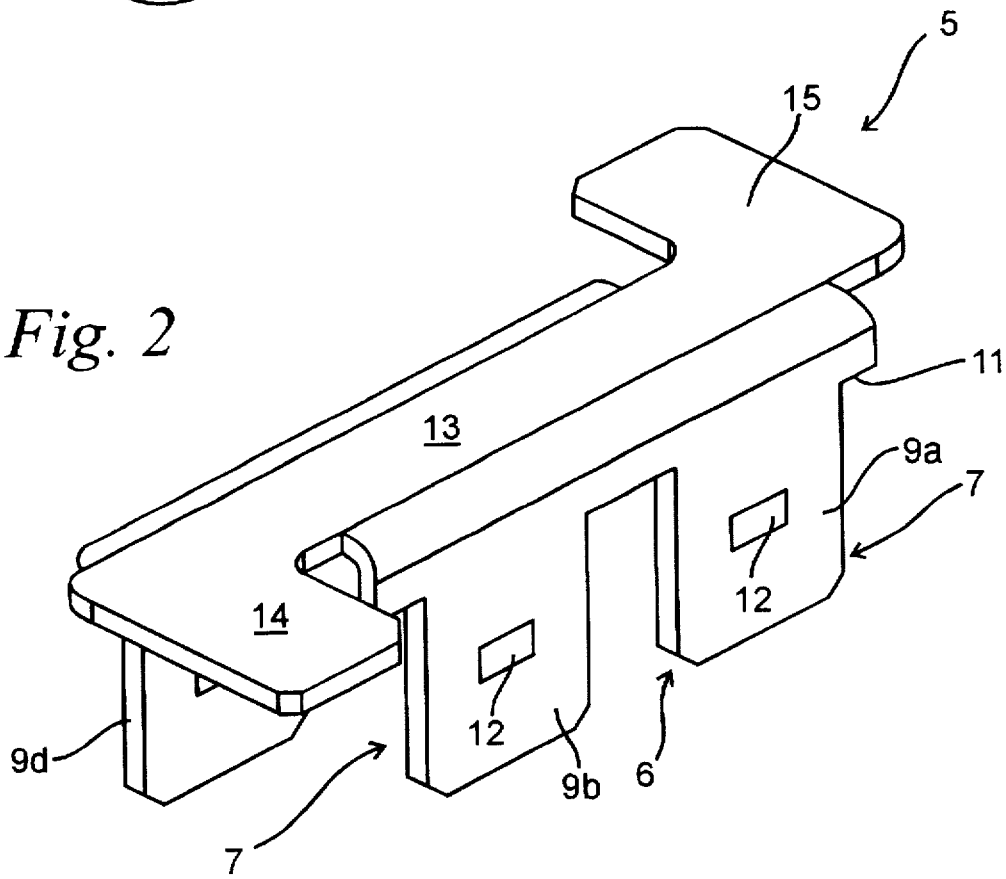
FIG. 2 is a perspective view, from below, of the terminal connector of FIG. 1.
Figure 4:
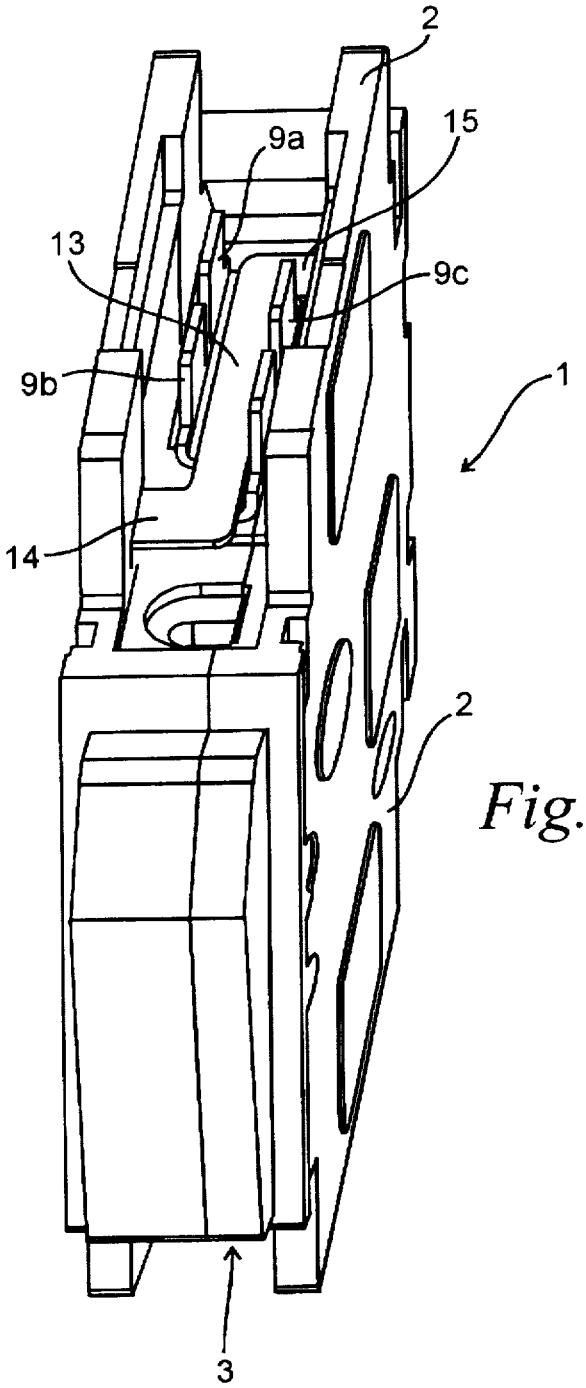
FIG. 4 is a perspective view from above of the circuit breaker with the terminal connector of FIGS. 1 to 3 in position.
Figure 10:
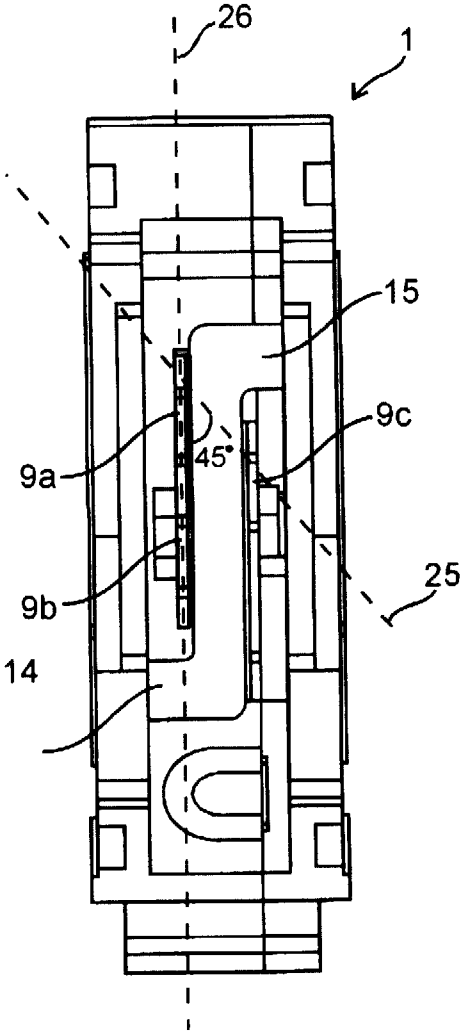
FIG. 10 is a sectional end view of the circuit breaker in the direction of the arrow 1*x* of FIG. 5 with no female spade wire connectors in position.

In more detail and referring particularly to FIGS. 1 and 2 the engagement means 6 is provided by four male spade connector terminals 9*a*, 9*b*, 9*c*, 9*d* which are arranged in this case in two spaced-apart and offset parallel rows 7 and 8, each row 7 and 8 having two of the male spade connector terminals. Each of the male spade connector terminals 9*a*, 9*b*, 9*c* and 9*d* extends outwardly from the mounting plate 13 for engaging with a corresponding female spade wire connector 10*a*, 10*b*, 10*c* and 10*d* at the end of wires from a load device (not shown). Each female spade wire connector 10*a* to 10*d* has a flattened plate 20, a grip 21 and an insulated upper end 22 (see FIG. 8). It will be noted that adjacent male spade connector terminals 9*a*, 9*c* and 9*b*, 9*d* are not aligned but are offset longitudinally by a distance greater than half the width and in this case approximately seventy five per cent of the width of each of the connector terminals 9*a* to 9*d*. This offset facilitates a maximum number of connector terminals 9*a* to 9*d* to be accommodated by the circuit breaker housing while allowing quick-fit connection to the female spade wire connectors, regardless of their orientation. Referring now in particular to FIG. 10 there is shown a plane passing through the centres of adjacent male spade connectors 9*a* in row 7 and 9*c* in row 8 indicated by the interrupted line 25. The plane 25 is at an acute offset angle in the range between one degree and sixty one degrees (approximately forty five degrees) to a plane 26 passing through the centres of the male spade connectors 9*a* and 9*b* of row 7.

The spacing between adjacent male spade terminals 9*a* and 9*b* is sufficient to allow simultaneous engagement by the female spade wire connectors 10*a* and 10*b*. Each of the rows 7, 8 is spread-apart sufficiently from the circuit breaker housing 2 to allow engagement by the female spade connector 10 in either orientation. A recess 23 in the housing 2 allows additional clearance for the insulated upper end 22 of the female spade connectors 10 to 10*d* to be connected in either orientation with the flattened portion 20 or the grip 21 beside the circuit breaker housing 2.

Each of the spade connector terminals 9*a*, 9*b*, 9*c*, and 9*d* incorporates a stop shoulder 11 for limiting engagement with the female spade wire connector 10. A limit stop is also provided on both sides of each spade connector terminal 9*a*, 9*b*, 9*c*, 9*d*, by an indentation 12 for maintaining engagement with the wire connectors in use. In this way positive contact between the terminals 9*a*–9*d* and the load device is assured regardless of the orientation of the female spade connector 10*a* to 10*d*.

The mounting plate has an associated locking means for locking the mounting plate 13 in position provided by two oppositely directed locking lugs 14, 15.

The lugs 14, 15 are co-planar with and located at opposite ends of the conducting plate 13 to form an S shaped plate. Each lug 14, 15 engages a corresponding recess 16, 17 in the circuit breaker housing 2 (See FIGS. 4 to 7).

Figure 3:
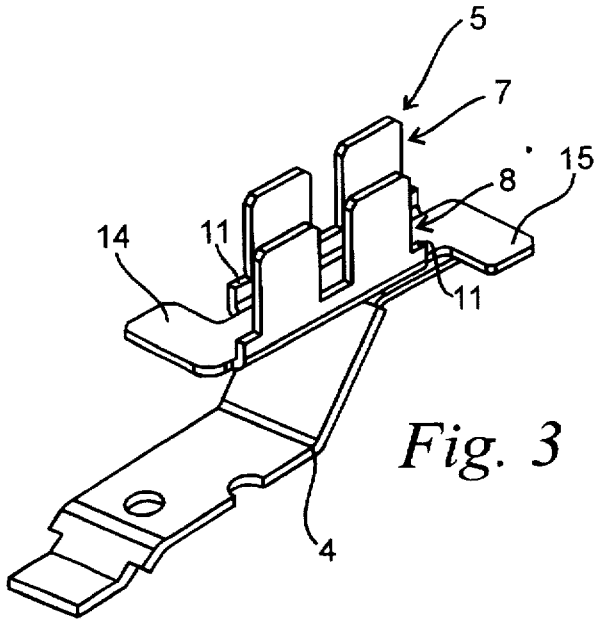
FIG. 3 is a perspective view of the terminal connector of FIGS. 1 and 2 connected to a supply terminal of a circuit breaker.
Figure 5:
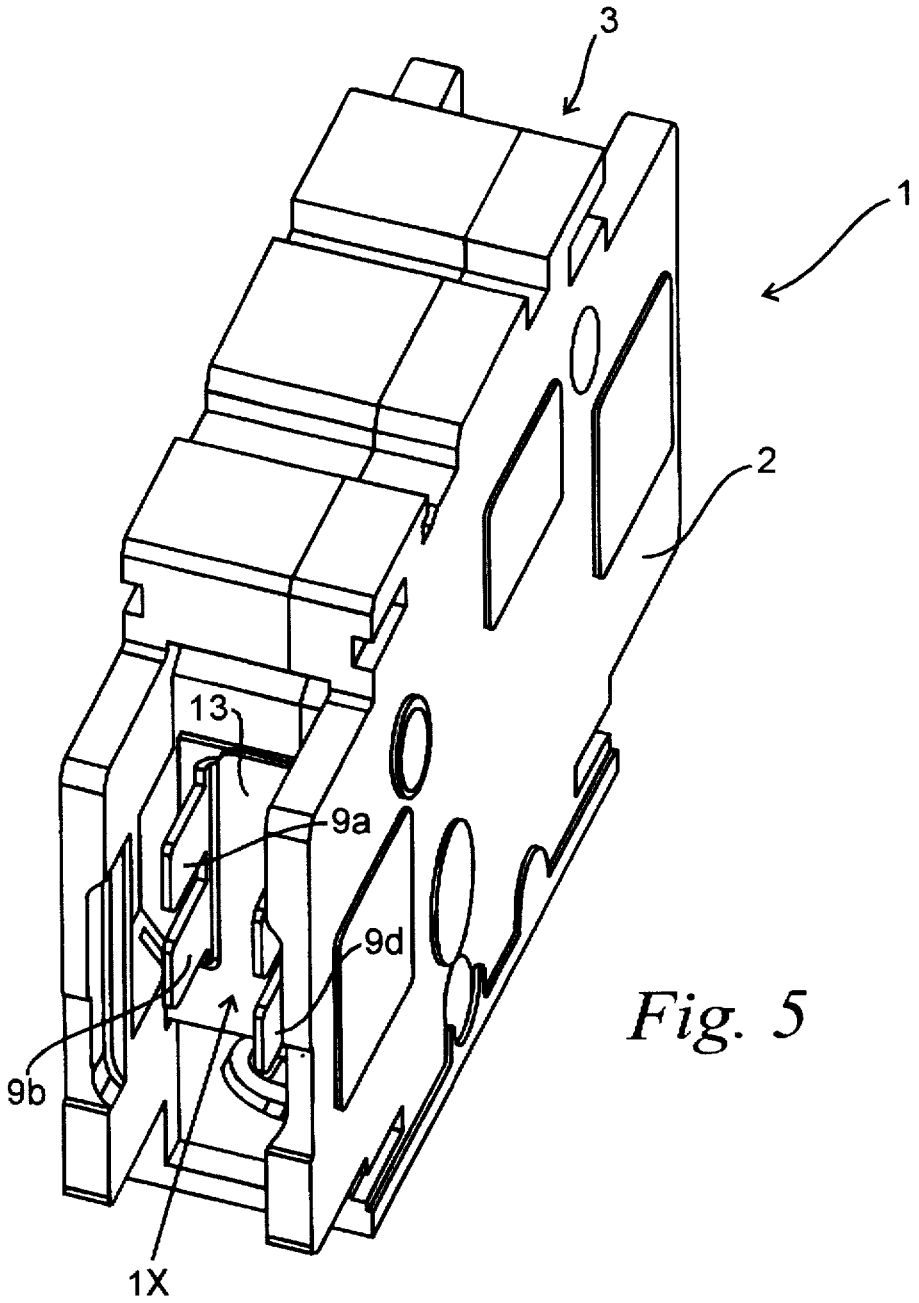
FIG. 5 is a perspective view from below of the circuit breaker with the connector of FIGS. 1 to 3 in position.
Figure 6:
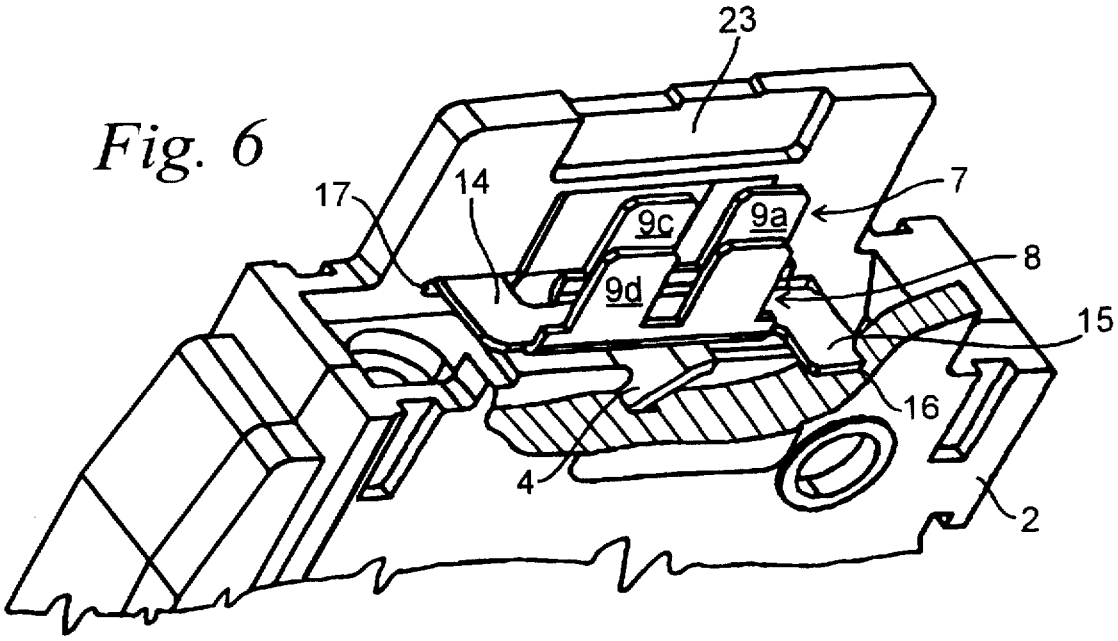
FIG. 6 is a perspective view of portion of the circuit breaker with the terminal connector of FIGS. 1 to 3 in position.
Figure 7:
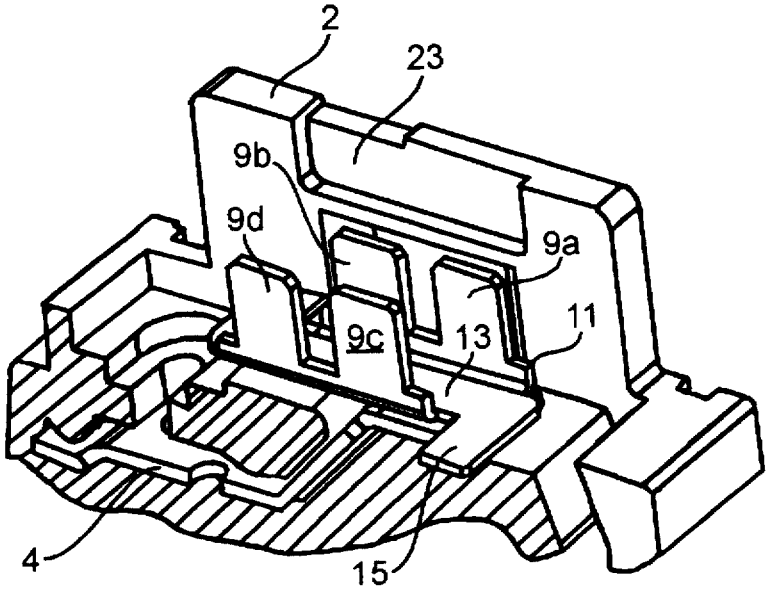
FIG. 7 is another perspective view similar to FIG. 6.
Figure 9:
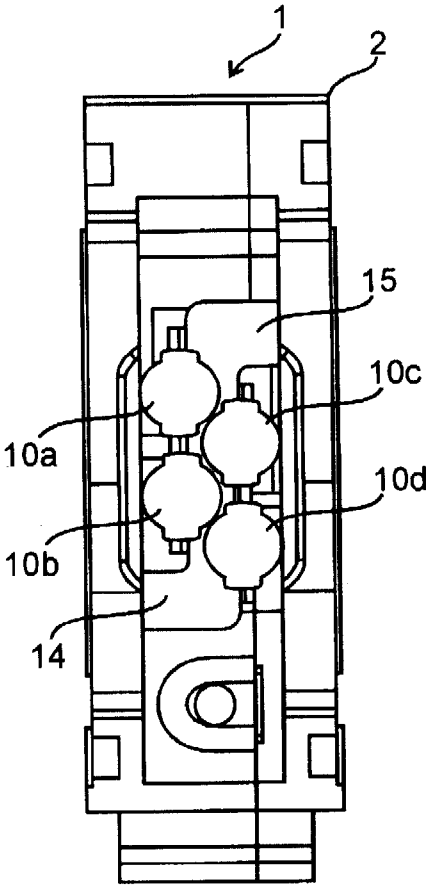
FIG. 9 is an end view of the circuit breaker in the direction of the arrow IX of FIG. 5 with four female spade wire connectors in position.
Figure 8:
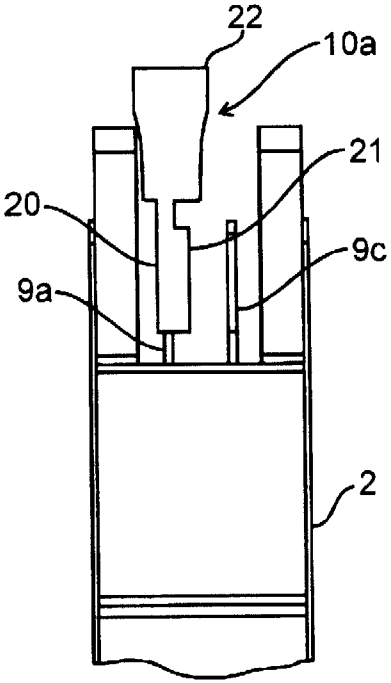
FIG. 8 is a side view of the circuit breaker in the direction of the arrow VIII of FIG. 4 with a female spade wire connector in position.

In use, the terminal connector 5 is mounted on the circuit breaker housing 2 with the lugs 14, 15 engaging the corresponding recesses 16, 17. The mounting plate 13 is electrically connected to the load terminal 4 of the circuit breaker 1 by welding or any other suitable method (see FIG. 3). When the terminal connector 5 is in position the female spade connectors 10*a*, 10*b*, 10*c*, 10*d* of the load device may be slidably engaged with the corresponding male terminal connectors 9*a*, 9*b*, 9*c*, 9*d*. Engagement between the female wire spade connector 10*a* and the male terminal connector 9*a* continues until the female spade connector 10*a* engages the stop shoulder 11 as shown in FIGS. 8 and 9. The indentation 12 of the terminal connector 9*a* engages the female spade connector 10*a* in this position to ensure positive electrical contact and secure the female spade connector 10*a* in position.

It will be appreciated that the connector described is generally S-shaped and may be easily mounted on the circuit breaker housing in either orientation.

It will be further appreciated that the support lugs may be positioned at any suitable locations on the conducting plate. There may be any suitable number of such mounting lugs.

While the embodiment described illustrates the use of four terminals it will be appreciated that there may be any number of connector terminals. Further, the connector terminals may be located at either end of the mounting plate.

It will also be noted that a connector block housing any required number and arrangement of female wire spade connectors to complement the male spade connectors on the current breaker may be provided to simultaneously connect or disconnect a number of load devices.

It will further be noted that while the connector terminals of the embodiment described are male spade connectors they could be equally provided by female spade connectors or any other suitable connection type without departing from the spirit of the invention.

Various changes, modifications and variations may be made to the arrangements described without departing from the scope of the invention.

What is claimed is:

1. A circuit breaker having a circuit breaker housing with at least two supply terminals and a terminal connector electrically connected to at least one supply terminal, the terminal connector being formed from a strip of conducting material having at least two upstanding spaced apart rows of laterally arranged male spade connectors interconnected by a mounting plate, adjacent male spade connectors in different rows being offset laterally, the mounting plate incorporating at least two oppositely directed, locking lugs, for engaging a corresponding formation on the circuit breaker housing.

2. A circuit breaker as claimed in claim 1 wherein the male spade connectors in each row are arranged in line.

3. A circuit breaker as claimed in claim 2 wherein adjacent male spade connectors in different rows are offset laterally by greater than half the width of a male spade connector.

4. A circuit breaker as claimed in claim 3 wherein adjacent male spade connectors in different rows are offset laterally by seventy five percent at the width of a male spade connector.

5. A circuit breaker as claimed in claim 1 wherein a plane passing through the centres of adjacent male spade connectors in different rows is at an acute offset angle of greater than one degree to a plane passing through the centres of adjacent male spade connectors in the same row.

6. A circuit breaker as claimed in claim 5 wherein the acute offset angle is between one degree and sixty one degrees.

7. A circuit breaker as claimed in claim 6 wherein the acute offset angle is forty five degrees.

8. A circuit breaker as claimed in claim 1 wherein each row of male spade connectors is spaced-apart sufficiently from the circuit breaker housing to allow engagement by a female spade connector in either a first orientation or a second orientation of the female spade connector.

9. A circuit breaker as claimed in claim 1 wherein adjacent rows of male spade connectors are substantially parallel.

10. A circuit breaker as claimed in claim 1 wherein at least one male spade connector incorporates a stop shoulder for limiting engagement with a load device.

11. A circuit breaker as claimed in claim 1 wherein at least one male spade connector incorporates at least one limit stop for maintaining engagement with a load device in use.

12. A circuit breaker as claimed in claim 1 wherein the male spade connector extend outwardly from the mounting means.

13. A circuit breaker as claimed in claim 1 wherein the mounting plate is substantially perpendicular to the male spade connectors.

14. A circuit breaker as claimed in claim 1 wherein the locking lugs and mounting plate are co-planar.

15. A circuit breaker as claimed in claim 1 wherein the locking lugs are located on opposite ends of the mounting plate.

16. A circuit breaker as claimed in claim 1 wherein the terminal connector is generally S-shaped and mountable on the circuit breaker housing in either a first orientation or a second orientation.

17. A circuit breaker terminal connector formed from a strip of conducting material having at least two upstanding, spaced apart rows of laterally arranged male spade connectors interconnected by a mounting plate, adjacent male spade connectors in different rows being offset laterally, the mounting plate incorporating at least two oppositely directed, locking lugs, for engaging a corresponding formation on a circuit breaker housing.

* * * * *